US009415974B2

(12) United States Patent
Perälä et al.

(10) Patent No.: US 9,415,974 B2
(45) Date of Patent: Aug. 16, 2016

(54) METHOD AND ARRANGEMENT FOR MOVING A HEAVY LOAD

(75) Inventors: Jussi Perälä, Hyvinkää (FI); Jouni Ratia, Hyvinkää (FI)

(73) Assignee: KONE CORPORATION, Helsinki (FI)

( * ) Notice: Subject to any disclaimer, the term of this patent is extended or adjusted under 35 U.S.C. 154(b) by 744 days.

(21) Appl. No.: 13/431,652

(22) Filed: Mar. 27, 2012

(65) Prior Publication Data

US 2012/0201638 A1 Aug. 9, 2012

Related U.S. Application Data

(63) Continuation of application No. PCT/FI2010/000058, filed on Sep. 28, 2010.

(30) Foreign Application Priority Data

Sep. 28, 2009 (FI) ..... 20090357

(51) Int. Cl.
*B66B 17/14* (2006.01)
*B66B 9/00* (2006.01)
(Continued)

(52) U.S. Cl.
CPC ..... *B66B 11/0484* (2013.01); *B66B 11/006* (2013.01); *B66B 17/14* (2013.01); *B66B 19/00* (2013.01); *B66B 11/06* (2013.01)

(58) Field of Classification Search
CPC ..... B66B 7/08; B66B 9/00; B66B 9/187; B66B 11/00; B66B 11/006; B66B 17/02; B66B 17/14; B66B 19/00; B66B 19/05
USPC ..... 187/414; 29/418, 423, 428, 429, 29/525.01; 52/741.1, 745.17, 750
See application file for complete search history.

(56) References Cited

U.S. PATENT DOCUMENTS 5,531,294 A 7/1996 Burton et al.
6,446,763 B1 * 9/2002 Glassey et al. ..... 187/414
(Continued)

FOREIGN PATENT DOCUMENTS

EP 0 613 850 A1 9/1994
EP 1 108 673 A2 6/2001
(Continued)

OTHER PUBLICATIONS

AIPN, Machine Translation, JP 0902048 A, Aug. 25, 2014, pp. 1-8.*

*Primary Examiner* — William A Rivera
*Assistant Examiner* — Stefan Kruer
(74) *Attorney, Agent, or Firm* — Birch, Stewart, Kolasch & Birch, LLP

(57) ABSTRACT

Method for moving a heavy load, in which method the heavy load is lifted or lowered with an elevator including an elevator car and a hoisting machine, which hoisting machine is arranged to move the elevator car from one level to another in the normal operation of the elevator, in which method the heavy load is moved to be supported by the elevator car and the elevator car is moved until the load is at the desired height, and the load is removed from the support of the elevator car. In the method a hoist that does not belong to the hoisting machine is temporarily connected to the elevator car for the purpose of moving the load, and the elevator car, which supports the load, is moved by the hoist until the load is at the desired height, and the load is removed from the support of the elevator car.

19 Claims, 1 Drawing Sheet

(51) Int. Cl.

| | |
|---|---|
| ***B66B 19/00*** | (2006.01) |
| ***B66B 11/06*** | (2006.01) |
| ***B66B 11/04*** | (2006.01) |
| ***B66B 11/00*** | (2006.01) |

(56) References Cited

U.S. PATENT DOCUMENTS

| | | | | |
|---|---|---|---|---|
| 7,559,409 | B2 * | 7/2009 | Barneman et al. | 187/408 |
| 7,624,848 | B2 * | 12/2009 | Fischer | 187/414 |
| 7,802,658 | B2 * | 9/2010 | Aulanko et al. | 187/266 |
| 2007/0256899 | A1 * | 11/2007 | Fanielle et al. | 187/408 |
| 2008/0308362 | A1 * | 12/2008 | Tucker | 187/414 |

FOREIGN PATENT DOCUMENTS

| | | | | |
|---|---|---|---|---|
| JP | 7-74074 | A | 3/1989 | |
| JP | 9-20480 | A | 1/1997 | |
| JP | 3146444 | B2 | 3/2001 | |
| WO | WO 2010100319 | A1 * | 9/2010 | B66B 9/187 |

* cited by examiner 1
2
3
4
5
6
7
8
L

METHOD AND ARRANGEMENT FOR MOVING A HEAVY LOAD

This application is a Continuation of PCT International Application No. PCT/FI2010/000058 filed on Sep. 28, 2010, which claims the benefit to patent application Ser. No. 20090357 filed in Finland, on Sep. 29, 2009. The entire contents of all of the above applications is hereby incorporated by reference into the present application.

FIELD OF THE INVENTION

The object of the invention is a method for moving a heavy load and an elevator arrangement for moving a heavy load by lifting and/or lowering the heavy load with an elevator.

BACKGROUND OF THE INVENTION

Every now and then there is a need to move heavy objects to inside a building or from one floor of a building to another. This type of need arises e.g. when replacing the transformer of a building. Often the transformer is disposed elsewhere than at street level, for which reason removing the old transformer from the building and bringing a new one into the place of the old one necessitates vertical moving of the transformers.

Lifting heavy objects to the highest floors of a building is performed in prior art by lifting the object to the desired height outside the building and moving the object to inside via an aperture in the wall of the building, or by lowering the object from above to inside the building or onto the roof. This type of method is awkward to implement and requires, among other things, arranging a crane for the site. On the other hand, a method is also known in the art wherein an elevator is used for moving heavy objects from one floor to another in a building. For this purpose the elevator must have been dimensioned to be capable in terms of its lifting capacity for this type of special lift. Special lifts/lowerings need to be performed perhaps only a few times during the lifetime of an elevator or of a building. One problem is that although a large lifting capacity is not required of the elevator in normal operation, the elevator must be dimensioned to be large owing to these rare lifting situations. The whole elevator system (including, among other things, a motor, a drive, electrical devices, hoisting ropes, guide rails, rope compensation and safety devices) must have been made according to the heaviest load to become heavier than the normal use of the elevator would require. The heavier dimensioning results in the elevator consuming considerably more energy during its lifetime and being more expensive in terms of its manufacturing costs and installation costs.

AIM OF THE INVENTION

The aim of the invention is to eliminate the aforementioned drawbacks, among others, of prior-art solutions. More particularly the aim of the invention is to produce an improved method and arrangement for moving a heavy load. The aim of the invention is further to produce one or more of the following advantages, among others:

- A method and an elevator arrangement are achieved, utilizing which the overdimensioning of an elevator for the purpose of a special lift can be avoided, but nevertheless the lifting capacity needed in a special lift is achieved.
- A method and an elevator arrangement are achieved, with which some heavy object, such as a transformer, can be removed and a replacement object, such as another transformer, can be brought into its place.
- A safe, inexpensive and simple method and an elevator arrangement are achieved, with which a heavy load can be moved.
- A method and an elevator arrangement are achieved, with which a heavy load can be moved, which load is one heavy object, the weight of which exceeds the nominal load of the elevator.
- A method and an elevator arrangement are achieved, in which the rope elongations caused by a heavy load can be compensated better than earlier and the rope forces can be better controlled than earlier, so that the actual lift to the target height can be started in a controlled and safe manner.

BRIEF SUMMARY OF THE INVENTION

The method according to the invention is a method for moving a heavy load and an elevator arrangement. The arrangement according to the invention is an elevator arrangement for moving a heavy load by lifting and/or lowering the heavy load with an elevator. Other embodiments of the invention can be defined to be characterized by what is disclosed in the other claims. Some inventive embodiments are also presented in the descriptive section and in the drawings of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments can be applied within the framework of the basic inventive concept in conjunction with other embodiments. The additional procedures/additional features of the invention defined in the non-independent claims could also be regarded separately from the procedures of an independent claim as separate inventions in their own right.

In the method according to the invention for moving a heavy load, the heavy load is lifted and/or lowered with an elevator, which elevator comprises an elevator car and a hoisting machine, which hoisting machine is arranged to move the elevator car from one level to another in the normal operation of the elevator, in which method the load is moved to be supported by the elevator car and the elevator car is moved until the load is at the desired height, and the load is removed from the support of the elevator car. In the method a hoist that does not belong to the aforementioned hoisting machine is temporarily connected to the elevator car for the purpose of moving the heavy load, and the elevator car, which supports the heavy load, is moved by means of the aforementioned hoist until the heavy load is at the desired height, and the heavy load is removed from the support of the elevator car.

In one embodiment of the invention the elevator car, which supports the heavy load, is moved by means of the aforementioned hoist until the heavy load is at the desired height, and the heavy load is removed from the support of the elevator car and the hoist is detached from the elevator car.

In one embodiment of the invention the force pulling the elevator car, which is supporting the heavy load, upwards is taken at least during the moving of the elevator car partly from the hoist temporarily connected to the elevator car and partly from the counterweight connected to the elevator car via the hoisting roping of the elevator.

In one embodiment of the invention when moving the elevator car by means of a hoist, which elevator car is supporting the heavy load, a force pulling the elevator car upwards is not exerted on the elevator car with the hoisting machine. More particularly, when moving the elevator car by means of a hoist, which elevator car is supporting the heavy load, a force pulling the elevator car upwards is not exerted on the elevator car with energy supplied from outside the elevator system to the hoisting machine, e.g. to the electric motor of the hoisting machine.

In one embodiment of the invention the weight of the heavy load is greater than the nominal load of the elevator.

In one embodiment of the invention the heavy load is the transformer of a building.

In one embodiment of the invention the hoist is connected to the elevator car such that the lifting capacity produced by it is in the temporary lifting arrangement greater than the lifting capacity that the hoisting machine produces in the lifting arrangement of normal operation. The hoist can thus be e.g. reeved such that, owing to its own characteristics and to the factor produced by (e.g. 1:2) reeving, it can produce a force on the elevator car which exceeds the force that the hoisting machine with its reeving could produce. One advantage is that the hoist is able to lift, without the participation of the hoisting machine in the lifting, a larger load than the hoisting machine. With a hoist it is thus possible to increase the lifting capacity, even though an upward pulling force on the elevator car would not be produced with the hoisting machine during the moving.

In one embodiment of the invention when the heavy load is being supported by the elevator car, the heavy load is inside the elevator car or on the roof of the elevator car.

In one embodiment of the invention before the heavy load is moved to be supported by the elevator car, the elevator is removed from normal operation, in which case e.g. the reacting of the elevator to landing calls is prevented.

In one embodiment of the invention when the heavy load is being moved to be supported by the elevator car and/or away from the support of the elevator car, the machinery brake is closed.

In one embodiment of the invention after the heavy load has been moved away from the support of the elevator car and after detachment of the hoist from the elevator car, the elevator is switched back to normal operating mode.

In one embodiment of the invention for connecting the hoist to the elevator car the elevator car is driven to the loading floor, or to the proximity of it, such that there is unobstructed access to the roof of the elevator car, after which the hoist is connected to the elevator car while working on the roof. After this the elevator is driven with the machine to the loading level, if needed.

In one embodiment of the invention the hoist is connected to the elevator car before moving the heavy load to be supported by the elevator car.

In one embodiment of the invention before moving the heavy load to be supported by the elevator car, the free plays of the hoist connected to the elevator car are removed, e.g. by lifting until the hoisting rope is taut, via which hoisting rope the hoist is connected to the elevator car. Thus the amount of subsidence of the car when the load is moved to the support of the car can be reduced. The tensioning might cause the car to rise. It is advantageous to allow a small rise of the car, preferably 10 mm at the most, more preferably 5 mm at the most. The small rise of the car is a simple sign of the tensioning of the hoisting rope of the hoist.

In one embodiment of the invention before transferring the machinery brake to the non-braking position an upwardly-directed force is exerted on the elevator car with the hoist, which force is preferably in its magnitude essentially the magnitude of the imbalance of the elevator.

Thus the risk of the car subsiding when the braking of the machinery brake is removed and the elevator car is moved to the support of the hoist can be reduced.

In one embodiment of the invention when the heavy load is being supported by the elevator car before transferring the machinery brake to the non-braking position, an upwardly-directed force is exerted on the elevator car with the hoist, which force is increased in steps. Thus the weight of the elevator car, and of the load supported by it, can be gradually increasingly transferred to the support of the hoist. Thus the support force of the elevator car produced by the friction of the traction sheave held in its position by machinery brake can be removed smoothly.

In one embodiment of the invention when the heavy load is being supported by the elevator car before transferring the machinery brake to the non-braking position, an upwardly-directed force is exerted on the elevator car with the hoist, which force is increased in steps by loosening the machinery brake intermittently and/or by intermittently driving the hoisting device upwards. Thus the weight of the elevator car, and of the load supported by it, can be gradually increasingly transferred to the support of the hoist. Thus the support force of the elevator car produced by the friction of the traction sheave held in its position by machinery brake can be removed smoothly at the same time removing the problem of subsidence from a floor, which might result from rope elongation of the hoist. The actual lift to the target height can be performed when the machinery brake is fully in the non-braking position.

In one embodiment of the invention the machinery brake is transferred to the non-braking position, after which the elevator car is moved by means of a hoist until the heavy load is at the desired height (during the moving the machinery brake is kept in the non-braking position).

In one embodiment of the invention in the method the hoist is connected to the elevator car via a hoisting rope or corresponding, preferably such that the hoist is supported from a rigid structure of the building, e.g. from the top part of the elevator hoistway or from the machine room.

In one embodiment of the invention when the elevator car, which supports the load, is moved, if an overspeed of the elevator car is detected, e.g. on the basis of the speed of the rope 8 of the hoist 3, or otherwise determined, the machinery brake of the elevator is activated.

In one embodiment of the invention the overspeed governor arrangement of the elevator is in use when the elevator car is moved by means of a hoist while the heavy load is being supported by the elevator car, which overspeed governor arrangement is arranged to start emergency braking to slow the movement of the elevator car after the limit value of the maximum permitted speed of the elevator car is exceeded, which limit value of the maximum permitted speed of the overspeed governor arrangement is preferably lower than in the normal operation of the elevator, when the elevator car is moved in normal operation by means of the hoisting machine without a hoist. In the aforementioned emergency braking, the overspeed governor arrangement preferably activates the brake, such as a safety gear, corresponding to the elevator car guide rails on the elevator car. During the lift with the hoist the aforementioned limit value of maximum permitted speed is preferably greater than the limit value after the exceeding of which the machinery brake of the elevator is activated.

In one embodiment of the invention during the moving of the elevator car the traction sheave of the hoisting machine rotates freely. Preferably the machinery brake is in the non-braking position, the electricity supply to the motor is disconnected, and the contactors of any dynamic braking are disconnected. In this way a safe and, in this respect, resistance-free lift is achieved.

In one embodiment of the invention in the method the hoist is connected to the elevator car via a hoisting rope or corresponding, which passes around at least one diverting pulley fixed to the elevator car, and the lifting ratio of the hoist is 1:N, where N is given the value 2, 3, 4, 5, 6, 7, 8, 9 or 10, preferably 2. In this way a large capacity can be achieved with a small hoist. Another advantage is that the hoist is not very prone to causing movements in the car. That is because with a 1:2 lifting ratio the distance risen by the car is smaller than the distance moved by the rope of the hoist. Thus the hoisting rope of the hoist can be tensioned in connection with the removing of free plays such that the car does not move upwards a great distance.

In one embodiment of the invention the elevator car, which supports the heavy load, is moved by means of the aforementioned hoist a distance of at least the length of one floor-to-floor distance, for moving a heavy load in a building or corresponding the aforementioned distance of at least the length of one floor-to-floor distance.

In one embodiment of the invention when the heavy load has been removed from the support of the elevator car, the next heavy load is moved to be supported by the elevator car, e.g. from the level to which the heavy load has been moved, and the elevator car, which supports the next heavy load, is moved by means of the aforementioned hoist until the next heavy load is at the desired height, and the next heavy load is removed from the support of the elevator car. One advantage is that a number of moves of heavy loads can be performed efficiently. The method is particularly suited to replacing a heavy object, when a heavy object must be removed from a building and its replacement brought into the space.

In one embodiment of the invention the next heavy load is greater in weight than the nominal load of the elevator.

In one embodiment of the invention when the next heavy load has been moved while being supported by the elevator car to the desired height by means of the aforementioned hoist, it is removed from the support of the elevator car, and the hoist is detached from the elevator car.

In one embodiment of the invention when the next heavy load has been removed from the support of the elevator car and the hoist has been detached from the elevator car, the elevator is switched back to normal operating mode.

In one embodiment of the invention when the heavy load or the heavy loads have been moved to the desired height/desired heights and moved away from the support of the elevator car, the hoist that does not belong to the aforementioned hoisting machine is detached from the elevator car and the elevator is returned to normal operation, in which normal operation the elevator car is moved with the hoisting machine from one floor to another and the elevator car is available for passengers to use.

According to the invention in the elevator arrangement for moving a heavy load by lifting and/or lowering the heavy load with an elevator, the elevator arrangement comprises an elevator car and a hoisting machine, which hoisting machine is arranged to move the elevator car from one level to another in the normal operation of the elevator. A hoist that does not belong to the aforementioned hoisting machine is temporarily connected to the elevator car for the purpose of moving the heavy load, by means of which hoist the elevator car is arranged to be moved until the heavy load is at the desired height. With the temporary elevator arrangement the lifting capacity of the elevator can be temporarily increased. One advantage is that the lifting capacity of the elevator arrangement temporarily exceeds the lifting capacity of the normal operation of the elevator in question. The hoist is connected to the elevator preferably such that the reeving of the normal operation of the elevator remains unchanged. In this way it is easy to return the elevator to normal operation after utilizing the hoist.

In one embodiment of the invention the weight of the heavy load is greater than the nominal load of the elevator. An elevator arranged in the manner described above can be arranged to lift a weight that is overlarge with respect to the normal operation of the elevator.

In one embodiment of the invention during the lifting of the heavy load the traction sheave rotated by the hoisting machine in normal operation is connected to rotate freely.

In one embodiment of the invention the hoist is connected to the elevator car (via a hoisting rope or corresponding, which passes around at least one diverting pulley fixed to the elevator car) with the lifting ratio 1:N, where N is given the value 2, 3, 4, 5, 6, 7, 8, 9 or 10, preferably 2. In this way a large capacity can be achieved with a small hoist. Another advantage is that the hoist is not very prone to causing movements in the car. That is because with a 1:2 lifting ratio the distance risen by the car is smaller than the distance moved by the rope of the hoist. Thus the hoisting rope of the hoist can be tensioned in connection with the removing of free plays such that the car does not move upwards a great distance.

The elevator arrangement can comprise the attributes connected to the procedures of the method, which attributes are described above and elsewhere in this application and/or the attributes described in the figures, either in combination or separately.

BRIEF DESCRIPTION OF THE SEVERAL VIEWS OF THE DRAWINGS

In the following, the invention will be described in detail by the aid of some examples of its embodiments with reference to the attached drawings, wherein.

DETAILED DESCRIPTION OF THE INVENTION

Figures 1, 2, 3, 4, 5:
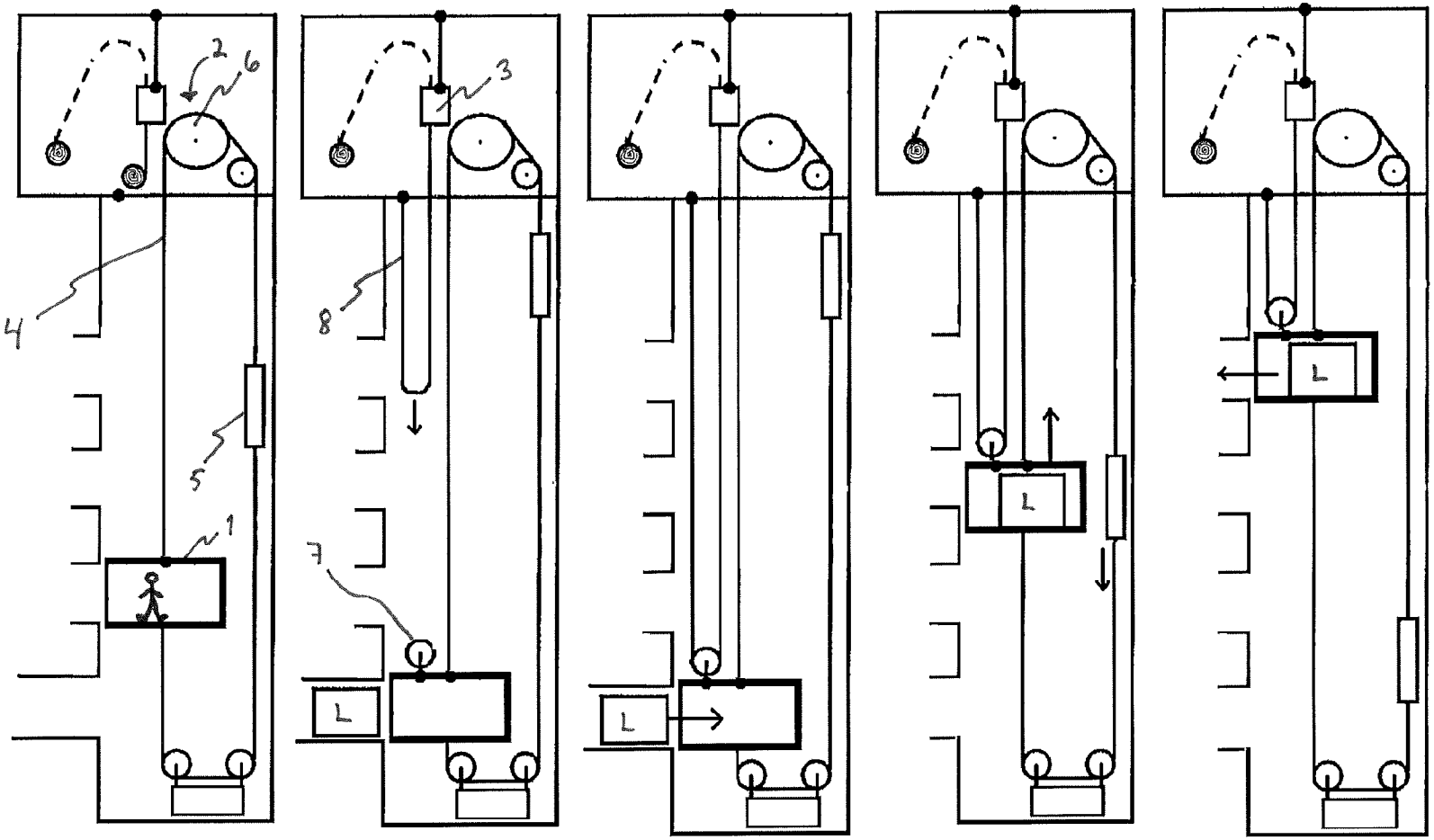
FIG. 1 presents an elevator in normal operation.
FIGS. 2-5 present the elevator arrangement according to the invention in the different phases of the method according to the invention.

FIG. 1 presents an elevator in normal operation, in which the elevator car 1 serves the users of a building and which elevator car is moved with a hoisting machine 2 via hoisting roping 4 from one level to another, which hoisting roping is moved with a traction sheave 6 rotated by the hoisting machine 2. The hoisting machine 2 (not visible in the figures) can comprise e.g. an electric motor as a power source.

In the method for moving a heavy load L from one floor to another, the heavy load L is lifted or lowered with an elevator according to FIG. 1 by means of a hoist 3 to be temporarily connected to the elevator system by moving the elevator car with the hoist 3, which elevator car is supporting the heavy load L. The method is particularly advantageous when the weight of the heavy load L is greater than the nominal load of the elevator. The heavy load L can be e.g. the transformer of a building. When the heavy load L is one heavy object, e.g. instead of a number of objects, the weight of it cannot be divided into different lifts. In this case the solution presented is extremely advantageous.

In the phase of the method presented in FIG. 2, the heavy load L is brought onto the loading platform. Before the heavy load L is moved to be supported by the elevator car 1, the elevator is removed from normal operation, in which case e.g. the reacting of the elevator to landing calls is prevented and the elevator can only be used by the personnel performing the special lift. In this phase a hoist 3 that does not belong to the hoisting machine 2 is temporarily connected to the elevator car 1 for the purpose of moving the heavy load L, which hoist is in the embodiment presented disposed in and supported from the machine room of the elevator (but alternatively could also be disposed and supported elsewhere, e.g. in/from the top part of the elevator hoistway). The hoist 3 is connected to the elevator car 1 before moving the heavy load L to be supported by the elevator car 1. For connecting the hoist to the elevator car the elevator car is driven to the loading floor (or alternatively to the proximity of it) such that there is unobstructed access to the roof of the elevator car, after which the hoist 3 is connected to the elevator car 1 via the hoisting rope 8 while working on the roof. The hoist 3 is connected to the elevator car 1 via a hoisting rope or corresponding, such that the hoisting rope 8 or corresponding passes around a diverting pulley fixed to the elevator car (1). Alternatively, the hoist could be connected to the elevator car with the lifting ratio 1:N, where N is given the value 2, 3, 4, 5, 6, 7, 8, 9 or 10. In the embodiment presented, in connecting the hoisting rope 8 to the elevator car 1, the end of the rope is first fixed to a stationary part of the building, e.g. in the proximity of the top end of the elevator hoistway or to the machine room, and the loop formed by the section of the hoisting rope between the fixing point of the hoisting rope 8 and the hoist 3 is lowered down to the elevator car. A diverting pulley is fixed to the roof of the elevator car, around which a loop of the hoisting rope is arranged to pass. The hoist 3 is such and is connected to the elevator car 1 such that the lifting capacity produced by it is in the temporary lifting arrangement greater than the lifting capacity that the hoisting machine 2 produces in the lifting arrangement of normal operation (FIG. 1). After connection of the hoist 3, the elevator car 1 is driven with the machine 2 to the loading level for loading if the elevator car is not at the point of the loading level.

In the phase of the method presented in FIG. 3, the heavy load L is moved to inside the elevator car (alternatively it could be disposed on the roof of the elevator) to be supported by the elevator car.

Before moving the heavy load L to be supported by the elevator car 1, the free plays of the hoist 1 connected to the elevator car are removed, e.g. by lifting until the hoisting rope is taut, via which hoisting rope the hoist 3 is connected to the elevator car 1. When the heavy load L is being moved to be supported by the elevator car and/or away from the support of the elevator car, the machinery brake is closed. Before transferring the machinery brake to the non-braking position an upwardly-directed force is exerted on the elevator car 1 with the hoist 3, which force is preferably in its magnitude essentially the magnitude of the imbalance of the elevator. The force reduces problematic jerks when the machinery brake is transferred to the non-braking position for the purpose of moving the elevator car. This force directed upwards on the elevator car (1) is increased preferably in steps by loosening the machinery brake intermittently and/or by intermittently driving the hoisting device upwards. By loosening the machinery brake the weight of the elevator car and of the heavy load inside it can be transferred to the support of the hoist 3. At the same time it is advantageous to run the hoist upwards so that the elevator car does not descend downwards owing to the elongations caused by the increasing force exerted on the hoist. The machinery brake can be loosened intermittently, in which case intermittent lifts are performed with the hoist between or during the intermittent periods. An intermittent period of loosening the machinery brake can be such that it permits slight movement of the traction sheave, in which case the rope tension of the hoisting ropes between the car and the traction sheave decreases and correspondingly the rope tension of the hoist 3 increases. The additional steps of the force of the hoist 3 can be performed singly or as a plurality, preferably until essentially all the imbalance of the elevator has moved to be supported by the hoist. After exerting the force, the machinery brake is fully transferred to the non-braking position and after it the elevator car 1 is moved with the hoist 3 until the heavy load L is at the desired height.

FIG. 4 presents the situation of the next phase of the method, wherein the elevator car and at the same time the heavy load L being supported by the elevator car are moved upwards. During the moving the machinery brake is kept in the non-braking position. The force pulling the elevator car (1), which is supporting the heavy load (L), upwards is taken during the moving of the elevator car 1 and of the heavy load L being supported by it partly from the hoist 3 temporarily connected to the elevator car and partly from the counterweight 5 connected to the elevator car via the hoisting roping of the elevator. The overspeed governor arrangement (not presented) of the elevator is preferably in use when the elevator car 1 is moved by means of a hoist 3 while the heavy load L is being supported by the elevator car 1, which overspeed governor arrangement is arranged to start emergency braking to slow the movement of the elevator car 1 after the limit value of the maximum permitted speed of the elevator car 1 is exceeded, which limit value of the maximum permitted speed of the overspeed governor arrangement is preferably lower than in the normal operation of the elevator, when the elevator car 1 is moved by means of the hoisting machine 2 without a hoist 3. One advantage is that the stopping distance of the especially large weight is safe.

When moving the elevator car by means of a hoist 3, which elevator car is supporting the heavy load L, a force pulling the elevator car 1 upwards is preferably not exerted on the elevator car with the hoisting machine 2. During the moving of the elevator car the traction sheave of the hoisting machine in this case rotates essentially freely. The machinery brake of the hoisting machine 2 is in the non-braking position, and preferably the electricity supply to the motor is disconnected, and preferably also any contactors of dynamic braking are disconnected.

FIG. 5 presents a situation, in which the heavy load L has been moved to the desired height. The elevator car, which is supporting the heavy load (L), has been moved a distance the length of a number of floor-to-floor distances, by means of the aforementioned hoist (3). The level (floor level of the inside space) of the elevator car, on which the heavy load L is, is level with the floor level, to which floor level it is desired to move the heavy load L. After the heavy load/elevator car has reached the desired level, the machinery brake is switched on. After this the heavy load can be moved away from the support of the elevator car (1). If it is not intended to use the elevator car any more for moving the heavy load off the level at which the elevator car is in this phase, the hoist is detached from the elevator car in this phase. When the heavy load has been moved away from the support of the elevator car (1) and the hoist (3) has been detached from the elevator car, the elevator is switched back to normal operating mode.

When the heavy load L has been removed from the support of the elevator car 1, the next heavy load can be moved to be supported by the elevator car from the level to which the heavy load L has been moved, which next load can be moved, in a manner corresponding to the method described above, to the desired height, e.g. to the floor level from which the heavy load L was moved to the support of the elevator car 1. The next heavy load can in this case also be greater than the nominal load of the elevator in terms of its weight. When the next heavy load has been moved while being supported by the elevator car to the desired height by means of the aforementioned hoist (3), it is removed from the support of the elevator car, and the hoist (3) is detached from the elevator car. After this the elevator is switched back to normal operating mode. The aforementioned next heavy load is preferably an object that corresponds to the heavy load L. Thus, with the method e.g. the transformer of a building can be replaced with another, e.g. with a serviced or new transformer.

By moving the next heavy load with the elevator car 1 it is possible to proceed as is described earlier in connection with the heavy load, e.g. insofar as producing the forces exerted on the elevator car and the use of braking are concerned.

The elevator arrangement according to the invention is described in the figures, more particularly in FIG. 4. In the elevator arrangement according to the invention for moving a heavy load by lifting and/or lowering the heavy load with an elevator, the elevator arrangement comprises an elevator car and a hoisting machine, which hoisting machine is arranged to move the elevator car from one level to another in the normal operation of the elevator. A hoist that does not belong to the aforementioned hoisting machine is temporarily connected to the elevator car for the purpose of moving the heavy load, by means of which hoist the elevator car is arranged to be moved until the heavy load is at the desired height. With the temporary elevator arrangement the lifting capacity of the elevator can be temporarily increased. The weight of the heavy load is greater than the nominal load of the elevator. An elevator arranged in the manner described above can be arranged to lift a weight that is overlarge with respect to the normal operation of the elevator. During the lifting of the heavy load the traction sheave rotated by the hoisting machine in normal operation is preferably connected to rotate freely. The elevator arrangement can comprise the structural attributes connected to the procedures of the method, which attributes are described above and elsewhere in this application and/or the attributes described in the figures, either in combination or separately. The elevator preferably comprises an overspeed governor arrangement defined elsewhere.

The invention can be utilized, if necessary, alternatively also such that the hoisting machine 2 can produce the upward-pulling force on the elevator car thus assisting the hoist 3 in moving the elevator car when the heavy load L is being supported by the elevator car 1. In the normal operation of the elevator, the elevator car 1 is moved from one level to another without the hoist 3, by means of the hoisting machine 2. The hoist 3 can be e.g. a Tirak hoist. In the solutions presented, when the heavy load is removed from the support of the elevator car, it can be e.g. moved out of the car 1 onto the landing. The elevator presented is preferably a passenger elevator. The elevator presented is preferably installed in a building, such as e.g. in multistorey apartment block. The elevator preferably comprises at least 2 floor levels. With the method and arrangement a heavy load can be moved for even long distances, e.g. a floor-to-floor distance consisting of 1, 2, 3, 4, 5 or 6 floors. FIGS. 1-5 present the moving of a heavy load upwards. With essentially the same arrangements and procedures, the heavy load can be moved downwards. When the heavy load is at first moved in a first direction and after its removal from the support of the elevator car, the next heavy load is moved e.g. in a second direction, which is opposite to the first direction, not all the phases of the method need to be performed between the moving of the heavy load and of the next heavy load because e.g. the hoist is already in position. The machinery brake comprised in the elevator is preferably an ordinary machinery brake. It can brake the movement of the elevator car via the hoisting ropes 8. The machinery brake is preferably arranged to act on the traction sheave 6 or on the machinery 2 that moves the traction sheave.

The overspeed governor arrangement can be e.g. a conventional one, which comprises a rope (not presented) that moves along with the car, which is connected to a safety gear (not presented) such that movement of the rope in relation to the car 1 trips the safety gear. The rope can be connected to the elevator car such that the diverting pulley 7 (or alternatively the fixing of the end of the rope to the car 1) is connected (e.g. on the roof of the car) to the rope of the overspeed governor such that a loose rope of the hoist always causes gripping (e.g. by means of the tightening of the rope of the overspeed governor, e.g. spring-loading).

It is obvious to the person skilled in the art that the invention is not limited to the embodiments described above, in which the invention is described using examples, but that many adaptations and different embodiments of the invention are possible within the frameworks of the inventive concept defined by the claims presented below. Thus it is obvious that the invention is also applicable for use in elevators without counterweight. It is also obvious that the hoist can be of a different type than what is presented, e.g. a hoist utilizing hydraulics.

The invention claimed is:

1. A method for moving a load, comprising the steps of:

lifting and/or lowering the load with an elevator, which elevator comprises an elevator car and a hoisting machine, which hoisting machine is arranged to move the elevator car from one level to another in a normal operation of the elevator for moving passengers;

connecting a hoist to the elevator car for moving the load, the hoist being separate from the hoisting machine;

removing the elevator from the normal operation;

moving the load into the elevator car, wherein the load is to be supported by the elevator car, and moving the elevator car by means of the hoist until the load is at a desired height; and removing the load from the elevator car, wherein, before moving the load supported by the elevator car, free play of a hoisting rope connected to the elevator car is removed by lifting the hoisting rope until the hoisting rope is taut, via which hoisting rope the hoist is connected to the elevator car, and wherein, before transferring a machinery brake from a braking position to a non-braking position, an upwardly-directed force is exerted on the elevator car by the hoist, which force is a magnitude of an imbalance of the elevator.

2. The method according to claim 1, wherein the force pulling the elevator car, which is supporting the load, upwards is taken at least during the moving of the elevator car partly from the hoist connected to the elevator car and partly from a counterweight connected to the elevator car via a hoisting roping of the elevator.

3. The method according to claim 1, wherein, when moving the elevator car by means of the hoist, which elevator car is supporting the load, a force pulling the elevator car upwards is not exerted on the elevator car by the hoisting machine.

4. The method according to claim 1, wherein a weight of the load is greater than a nominal load of the elevator.

5. The method according to claim 1, wherein the load is a transformer of a building.

6. The method according to claim 1, wherein the hoist is connected to the elevator car and a lifting capacity produced by it is greater than a lifting capacity than that which the hoisting machine produces during normal operation of the elevator for moving passengers.

7. The method according to claim 1, wherein, before the hoist is connected to the elevator car for purpose of moving the load, the elevator is in normal operation for moving passengers during which the elevator car is moved by the hoisting machine from one floor to another.

8. The method according to claim 1, wherein, before the load is moved into the elevator car, the elevator is removed from normal operation such that responding to landing calls is prevented.

9. The method according to claim 1, wherein, the load is at least one of a plurality of loads and the desired height is at least one of a plurality of heights, and wherein, when each of said loads has been moved to at least one of said plurality of heights and moved away from the support of the elevator car, the hoist is detached from the elevator car and the elevator is returned to normal operation for moving passengers during which the elevator car is moved by the hoisting machine from one floor to another and the elevator car is available for passengers to use.

10. The method according to claim 1, wherein, after the load has been moved away from the support of the elevator car and after detachment of the hoist from the elevator car, the elevator is returned to normal operation for moving passengers.

11. The method according to claim 1, wherein the hoist is connected to the elevator car before moving the load into the elevator car.

12. The method according to claim 1, wherein, when the load is being supported by the elevator car before transferring the machinery brake to the non-braking position, the upwardly-directed force is exerted on the elevator car by the hoist, which force is increased in steps.

13. The method according to claim 1, wherein, before transferring the machinery brake to the non-braking position, the upwardly-directed force is exerted on the elevator car by the hoist, which force is increased in steps by loosening the machinery brake intermittently and/or by intermittently driving the hoisting device upwards.

14. The method according to claim 1, wherein, after the machinery brake has been transferred to the non-braking position the elevator car is moved by the hoist until the load is at the desired height.

15. The method according to claim 1, wherein an overspeed governor arrangement of the elevator is in use when the elevator car is moved by means of the hoist while the load is being supported by the elevator car, which overspeed governor arrangement is arranged to start emergency braking to slow the movement of the elevator car after a limit value of a maximum permitted speed of the elevator car is exceeded, which limit value of the maximum permitted speed of the overspeed governor arrangement is lower than in the normal operation of the elevator, when the elevator car is moved by means of the hoisting machine without a hoist.

16. The method according to claim 1, wherein, when the load has been removed from the support of the elevator car, a next load is moved to be supported by the elevator car from the level to which the load has been moved previously, and the elevator car, which supports the next load, is moved by means of the hoist until the next load is at the desired height, and the next load is removed from the support of the elevator car.

17. The method according to claim 1, wherein a weight of the load is greater than a nominal load of the elevator.

18. The method according to claim 1, wherein the hoist is connected to the elevator car with a 1:2 lifting ratio.

19. An elevator arrangement for moving a load by lifting and/or lowering the load with an elevator, which elevator comprises an elevator car and a hoisting machine, which hoisting machine is arranged to move the elevator car from one level to another in a normal operation of the elevator for moving passengers, wherein a hoist is connected to the elevator car for moving the load, by means of which hoist the elevator car is arranged to be moved until the load is at a desired height, the hoist being separate from the hoisting machine, wherein, before moving the load supported by the elevator car, free play of a hoisting rope connected to the elevator car is removed, by lifting the hoisting rope until the hoisting rope is taut, via which hoisting rope the hoist is connected to the elevator car, and wherein, before transferring a machinery brake from a braking position to a non-braking position, an upwardly-directed force is exerted on the elevator car by the hoist, which force is a magnitude of an imbalance of the elevator.

* * * * *